United States Patent [19]

Yoshida

[11] Patent Number: 4,498,321

[45] Date of Patent: Feb. 12, 1985

[54] METHOD OF AND APPARATUS FOR FORMING LONG METAL TUBING STOCK TO TAPERED SHAPE

[76] Inventor: Keiichiro Yoshida, 641, Mobara, Chiba, Japan, 297

[21] Appl. No.: 512,126

[22] Filed: Jul. 8, 1983

[30] Foreign Application Priority Data

Jul. 9, 1982 [JP] Japan ..... 57-120346

[51] Int. Cl.[3] ..... B21J 7/16

[52] U.S. Cl. ..... 72/76; 72/402

[58] Field of Search ..... 72/76, 402, 472, 478

[56] References Cited

U.S. PATENT DOCUMENTS

| | | | |
|---|---|---|---|
| 2,642,762 | 6/1953 | Evans | 72/76 |
| 2,734,404 | 2/1956 | Batty | 72/76 |
| 3,273,367 | 9/1966 | Hallden | 72/76 |
| 3,812,699 | 5/1974 | Koost et al. | 72/76 |

FOREIGN PATENT DOCUMENTS

| | | | |
|---|---|---|---|
| 2547821 | 4/1977 | Fed. Rep. of Germany | 72/402 |

*Primary Examiner*—E. Michael Combs
*Assistant Examiner*—Charles Rosenberg
*Attorney, Agent, or Firm*—Wenderoth, Lind & Ponack

[57] ABSTRACT

The method and apparatus permit a relatively long metal tubing stock to be finished to any desired tapered shape through a single-pass operation. The apparatus is provided in the form of a tandem configuration including any number of individual swaging units each having the identical construction including the same working parts and assemblies. The grooved roll arrangement associated with the tandem-configured swaging units is used as a preliminary step, and forms an initial metal tubing stock to a multiple-stepped shape.

6 Claims, 13 Drawing Figures

24
30
29
26
1
$d_1$
$d_2$
$d_3$
$d_4$
$d_n$
$l_0$
$l_1$
$l_2$
$l_3$

METHOD OF AND APPARATUS FOR FORMING LONG METAL TUBING STOCK TO TAPERED SHAPE

BACKGROUND OF THE INVENTION

1. Field of the Invention

The present invention relates generally to the metal tubing working process, and more particularly to a method of and an apparatus for forming a metal tubing stock to any desired tapered shape by means of the swaging process, in and by which a relatively long metal tubing stock can be handled and finished to a tapered shape through a single step of the swaging process.

2. Description of the Prior Art

The metal tubes or hollow rods of relatively great length which are manufactured by means of the swaging process to provide tapered shapes are usually used for the light-equipped poles, flag carrying poles, electrical power wire supports, and other similar purposes. For the manufacture of such articles as mentioned above, the conventional swaging process, which may take place in the form of the method or apparatus, includes multiple steps which are different and separate from each other. An initial stock must be passed through those step-by-step procedures until it can finally be finished to the desired shape. The steps start with cutting a metal blank to a tapered shape in plane, followed by forming it to a tapered tubing with the opposite longitudinal edges left unjoined together. Then, the next step proceeds to cause the edges of the tubing to be joined together by means of the welding process. Any undesired portions that are present along the welded edges of the tubing are removed at the next following step by means of the final polishing or finishing process. The product which has been obtained through the above steps has a relatively simple form or profile, but the manufacture of such a product involves many steps each including a different process as described above. As a whole, a combination of those different and separate processes permits the manufacture of the product, thus making the highly efficient mass production. This increases the manufacturing costs for each item. A single-step swaging process is also known, in which the swaging machine is specifically designed to provide a small-length tapered metal tubing which is analoguous in profile (such as forks for a bicycle which are about 400 mm long). For the long tapered tubes which are totally 4 m to 10 m long, such as the light-equipped poles and others that are mentioned above, it is thought that it is practically impossible to implement the single-step swaging process. Also, there is no swaging machine that provides the single-step swaging processing functions. The present inventor proposed his previous invention that was related to the use of a relatively long spindle in the swaging machine, and was intended to prevent the occurrence of excessive deformation of the spindle, reduction in its rigidity and occurrence of its damage or breakage, which is now published in the official Japanese patent publication No. 57-4421 after the examination. The above invention discloses the spindle which is about 1 m at the longest, which cannot be used for the single-step swaging process that permits the manufacture of 4 m or longer tapered poles. When using that spindle for the manufacture of a 4 m-length tapered pole, at least four steps were required.

SUMMARY OF THE INVENTION

In order to eliminate the above described problems, the present invention provides a swaging machine construction that consists of several swaging units arranged in series in a tandem configuration, each swaging unit including a flywheel which also acts as an anvil, and a set of metal dies. In the tandem configuration, the dies sets in the swaging units are arranged sequentially from one to another. On the entry side of the tandem configuration machine, a tubing stock of a prescribed length which is to be tapered is inserted, progressing through the machine toward the other side thereof. While the tubing stock is being fed forward, it is sequentially processed by the dies in the swaging units that provide the tapered shape over the length. After having been processed through all the dies, the stock is formed to a totally tapered shape. As readily understood from the above description, a long tubing stock can be finished to a tapered shape through the single-step process. The above described tandem-configured swaging machine can also be used to handle a multi-stepped metal tubing which has previously been obtained by processing a uniform-diameter tubing stock through the preliminary grooved roll sets which are arranged at regular intervals. In this case, the use of the tandem-configured swaging machine provides the multi-stepped tube with little or no variation in the thickness between the larger diameter side and smaller diameter side. Each swaging unit consists of a cylindrical flywheel which contains a hammer roll assembly, a spindle assembly, buckers, striking rods, and dies which are all mounted in that order within the flywheel. Those swaging units are arranged in a series to provide a tandem configuration, the number of them being arbitrary depending upon the length of a tubing stock to be swaged. The swaging machine which comprises the tandem-configured swaging units provides a less costly and more efficient means of forming a relatively long tubing stock to any desired tapered shape. Thus, the mass production can be achieved. All the problems that have been mentioned earlier in this section can be eliminated by using the method and apparatus according to the present invention.

It is known that there are various technologies and facilities for manufacturing metal tubes that have a uniform diameter along the length, and the metal tubes manufactured from those facilities are commercially available in a variety of forms. It should be noted that the present invention can be applied to such uniform-diameter tubes, making effective use of them as input sources. It is also known that those metal tubes have no problem with respect to the mechanical properties such as homogeneity and strength. The method and apparatus provided by the present invention can produce the tapered tubes whose proper homogeneity is not affected. Other advantages to be noted are the single-step production that provides a completely tapered tube through one pass, and the elimination of the use of the weldtype metal tubes whose longitudinal edges are joined together in a preliminary process. As mentioned in the preceding descriptions, the use of such weld-type metal tubes has led to the multiple-step manufacturing process instead of the single-step one that is aimed at in the present invention. Totally, therefore, the present invention provides a significantly improved manufacturing efficiency.

In addition to the above advantages, the present invention allows for the use of the multi-stepped metal tubes which are previously processed to provide a small thickness. The reduction in diameter for the multi-stepped tubes that occur at each stage of the swaging process, therefor, can be minimized, resulting in improved processing efficiency in terms of the required working time and labor economy. The area of the tube which is located before and after each stepped portion can have a slight increase in thickness with the resulting increased strength, after the tube has been finished.

BRIEF DESCRIPTION OF THE DRAWINGS

Those and other objects and advantages of the present invention will become clear from the description that follows by referring to the preferred embodiments shown in the accompanying drawings, in which.

DETAILS OF THE PREFERRED EMBODIMENTS

Figure 1:
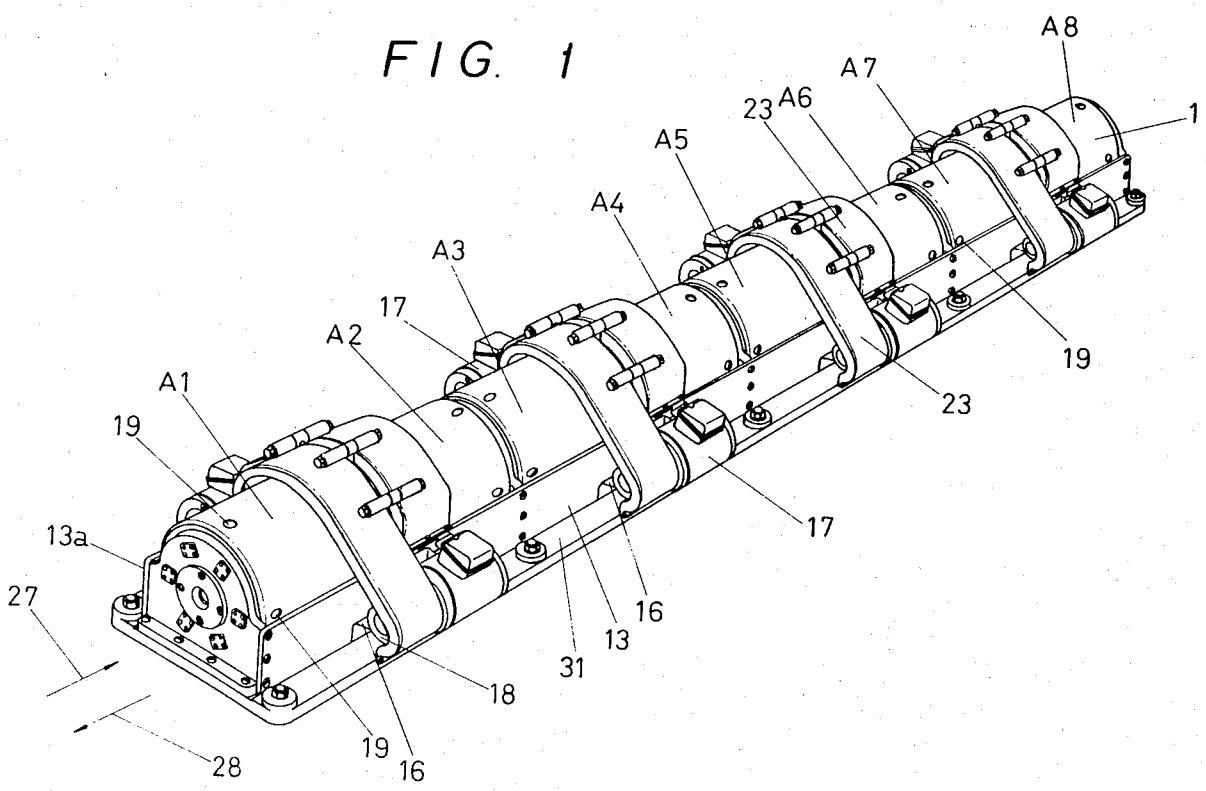
FIG. 1 is a perspective view of an embodied form of the apparatus according to the present invention.
Figure 3:
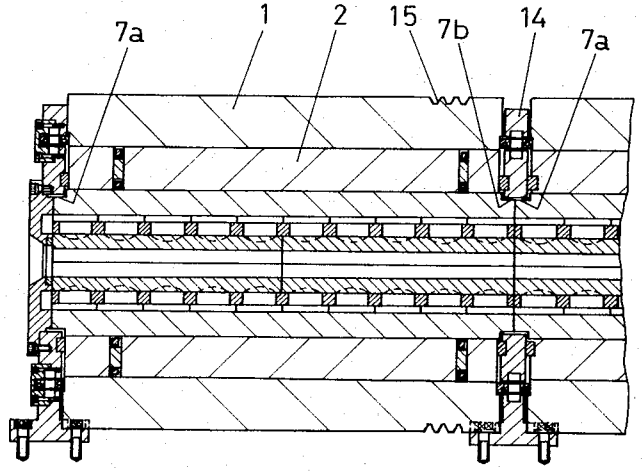
FIG. 3 is a partly sectional view of FIG. 1 illustrating the internal arrangement as viewed on an enlarged scale.
Figure 2:
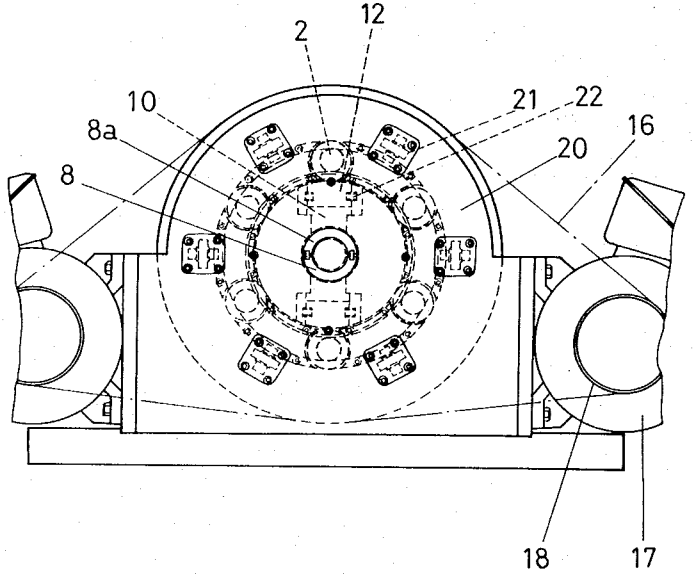
FIG. 2 is an enlarged side elevation of the apparatus in FIG. 1 with some portions omitted for clarity of the description.
Figure 5:
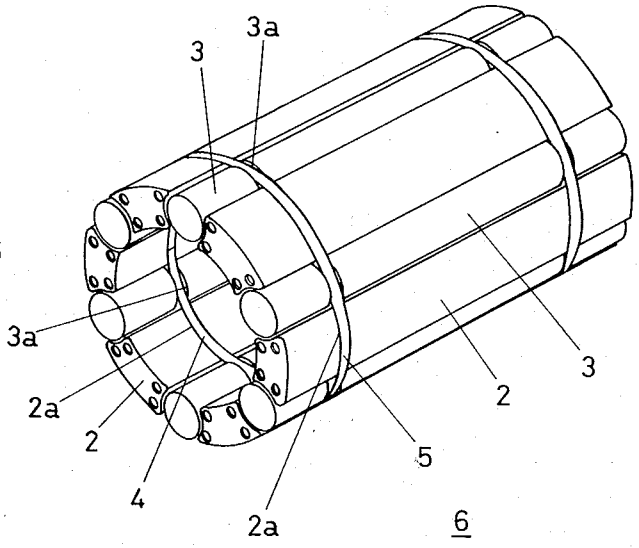
FIG. 5 is an enlarged perspective view illustrating how the hammer rolls are arranged in the swaging unit of FIG. 4.
Figure 6:
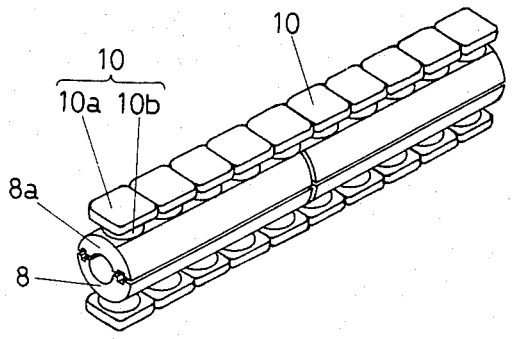
FIG. 6 is an enlarged perspective view illustrating the relative position between the dies and the successive striking rods.
Figure 7:
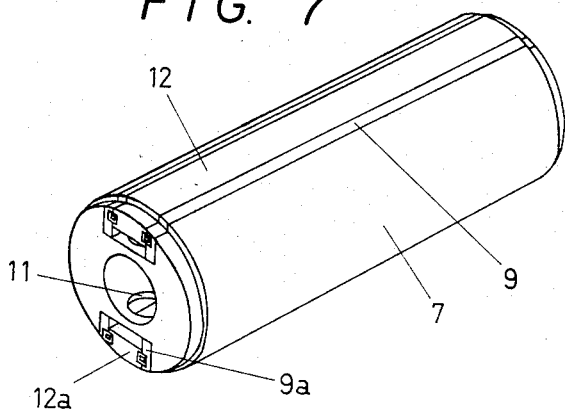
FIG. 7 is an enlarged perspective view illustrating the structure of the spindle including its component parts.

The following description is first directed to the illustration of the construction of the apparatus according to one preferred embodiment of the present invention, the details being also shown in the accompanying drawings. In FIG. 1, the general perspective view of the swaging machine is presented, and the machine is specifically designed to handle an 8 m-long pole which is to be tapered. As shown, its construction includes eight swaging units which are arranged in a tandem configuration, each having an identical construction and providing the same swaging functions. FIG. 2 presents the common construction for all swaging units as viewed from the side and shown on an enlarged scale. In FIG. 3, a sectional view is presented, illustrating the internal structure of one swaging unit (which is located on the entry side for a stock) and connections with the next succeeding unit which is partly shown. A perspective view of the swaging unit is given in FIG. 4, which illustrates the internal disposition of the principal component parts or elements in the swaging units. Different assemblies which are all put together to constitute one complete swaging unit are presented in FIGS. 5 to 7. FIG. 5 is a perspective view illustrating the disposition of the hammer roll assembly as viewed on an enlarged scale. FIG. 6 presents the assembly including the dies and striking rods, in order to aid in understanding how those two different portions are disposed relative to each other. A perspective view is presented on an enlarged scale in FIG. 7, illustrating the construction of the spindle with its buckers mounted. As clearly seen from the above-cited figures, the swaging machine according to the present invention is constructed from a number of the individual swaging units which are arranged in a tandem configuration, the number of the units being optionally variable depending upon the length of a tubing stock to be worked to a tapered shape. For example, when each of elongated dies incorporated in each unit has a length of 1 m and when the length of a tubing stock to be tapered has any one of the lengths from 4 m to 10 m, the configuration of the machine may include any number of the units between 4 and 10, depending upon the length of the selected work. In the following description, the structure of the swaging unit is first described, and then the construction of the machine as a whole is described. Before going to details, it should be noted that all swaging units have an identical construction, and therefore the following description is limited to any one of the units, which applies similarly to the remaining units.

Figure 4:
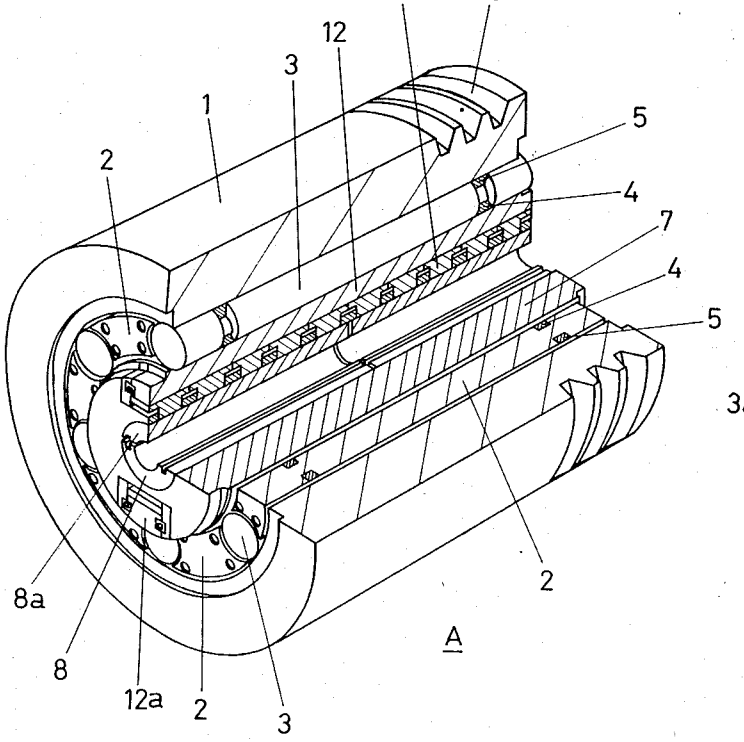
FIG. 4 is a sectional perspective view of any one of the tandem-configured swaging units, illustrating the internal arrangement of the principal parts as viewed on an enlarged scale.

Referring first to FIGS. 3 and 4, which show the internal arrangement of the swaging unit, it has a cylindrical form in general profile which includes a fly wheel 1 made of a metal cylindrical casing, and a cylindrical form combination 6 consisting of spacer members 2 made of a mechanically strong and lightweight synthetic resin material (for example, such as nylon, Delrin and the like) and hammer rolls 3 which is mounted inside the flywheel 1. In the inner cylindrical combination 6, the hammer rolls 3 are arranged at equal angular intervals of a circle and each of the spacer members 2 is interposed between every two adjacent hammer rolls. Those hammer rolls 3 and spacer members 2 in their respective positions are fastened together by means of binding ring members 4 and 5 which are fitted around the inner and outer sides of the combination, thus forming totally the inner cylindrical combination 6. As the construction of the combination 6 is shown in FIG. 5, it includes six spacer members 2 and six hammer rolls 3, the number of which may be varied as appropriate. As described, each of the spacer members 2 separates the two adjacent hammer rolls 3. Each of the spacer members 2 has a groove **2*a* on each of the opposite sides thereof which is located nearer to the opposite ends. The grooves 2*a* on both the sides are formed on the outer and inner sides of the spacer 2 at the corresponding positions. Similarly, each of the hammer rolls 3 has a groove 3***a* on each of the opposite sides thereof which is located nearer to the opposite ends, the grooves 3*a* on both the sides being formed on the outer and inner sides of the hammer roll at the corresponding positions. The inner and outer grooves 2*a* and 3*a* in all the spacers and hammer rolls are aligned to allow the binding rings 4 and 5 to be fitted therein. The binding rings 4 and 5 fasten the spacers and hammer rolls so securely that they cannot slide in the axial direction. The presence of those grooves also provides easy assembly and mounting into the outer flywheel casing 1. The cylindrical combination 6 has a central hole extending through the length thereof, through which a cylindrical-form spindle 7 is accommodated. The spindle 7 has a central longitudinal aperture, into which a die formed by two split parts 8 and 8*a* is inserted. As shown in FIG. 7, the spindle 7 has grooves 9 and 9*a* which are formed on the outer wall thereof in the diametrically opposite positions, the grooves extending in the axial direction in parallel with the central axis of the spindle 7. The grooves 9 and 9*a* accommodate buckers 12 and 12*a* which are later to be described. Each of the bucker grooves has apertures 11 formed in the bottom, which are aligned in the axial direction of the groove and are placed opposite the corresponding apertures 11 on the other groove. The apertures 11 accommodate the corresponding striking rods 10 which are aligned in the axial direction of the spindle 7, each of the striking rods 10 having an enlarged head 10*a* and a rod 10*b* below it. The striking rods are capable of radial movement through the corresponding apertures 11. For each of the striking rod sequence on the grooves 9 and 9*a*, a single bucker 12, 12*a* is mounted in contact with the striking rod sequence so that it can act on the hammer rods 10 to place the latter under impact pressure all at one time. The swaging machine according to the present invention is structured to include an appropriate number of the swaging units A, the construction of which has been described commonly to all the swaging units. The required number of such swaging units are arranged sequentially in a tandem configuration according to the size and shape of the dies in the individual swaging units, each of which provides its specific size and shape die. For example, it is assumed that each of the swaging units A includes a die which is 1 m long. Then, in order to process a tubing stock whose length is any of the lengths from 4 m to 10 m, the machine can be tandem-configured to include the corresponding number of the swaging units that is from four to ten depending upon the length of the tubing stock.

The tandem-configured swaging units which construct the total swaging machine are securely mounted on a machine pedestal 31. The pedestal 31 includes two side frames 13 and 13*a* on the opposite sides thereof which extend in the longitudinal direction of the pedestal, and sets of annular support frames 14 and 14 which are provided at regular intervals in the logitudinal direction of the pedestal where the connections are to be made between two adjoining swaging units. Each set of the annular support frames 14 and 14 across the pedestal at the different positions thereof holds the spindles 7 for the adjoining swaging units. The spindle 7 for each of the swaging units has stepped portions 7*a* and 7*b* at the abutting ends thereof, which are to be received into and securely held by the annular support frames 14 and 14 in each set. When the abutting ends of the two adjoining spindles are brought into contact with each other by being securely held by the annular support frames 14 and 14, the abutting ends of the dies 8 and 8*a* within the adjoining spindles are also brought into contact with each other. Thus, all the dies form a continuous working passage through which a work is allowed to pass. The flywheel 1 for the swaging unit A has several V-grooves 15 around the outer wall on one side thereof. Those V-grooves 15 engage a V belt 16 which also engages V pulleys 18 on shafts of motors 17 on the opposite sides of the pedestal 31. The output power from the motors 17 is transmitted through the V belt 16 to the flywheel 1 for rotation. The flywheel 1 has apertures 19 at appropriate positions around the outer wall, those apertures serving to permit manual rotation of the flywheel 1. In addition to the functional parts which have been described, the swaging unit includes a cover 20 for the exposed end thereof, thrust bearings 21 located in a spaced relationship around the abutting end for allowing the abutting ends for the adjoining flywheels rotatably to be supported, stoppers 22 for each of the buckers, and a cover 23 mounted over the V belt 23.

Figures 8, 9, 10, 11:
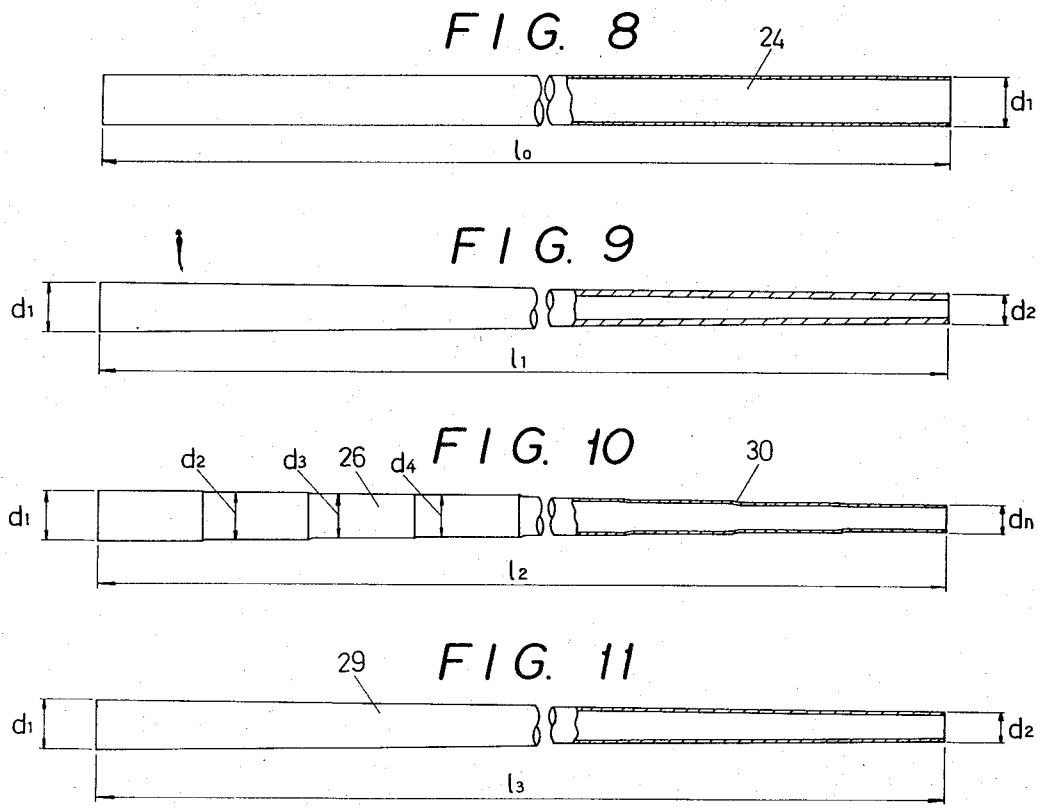
FIG. 8 is a partly sectional view of an initial metal tubing stock of a length to be tapered with its intermediate portion omitted.
FIG. 9 is a partly sectional view of the metal tubing that has been finished, with its intermediate portion omitted.
FIG. 10 is a partly sectional view of a multiple-stepped metal tubing stock of a length next to be tapered, with its intermediate portion omitted.
FIG. 11 is a partly sectional view of the tapered metal tubing that has been finished, with its intermediate portion omitted.

The operation of the tandem-configured swaging machine is now described. In the following description, it is assumed that the swaging machine is specifically built to handle a long metal tubing stock, which is for example 8 m in length. This configuration has been described above and is shown in FIG. 1. An initial tubing stock 24 has a uniform diameter over the length, as shown in FIG. 8. As a preliminary step, this stock 24 is processed through a series of the multi-step grooved rolls 25 (FIG. 12 and 13) so that it can provide a multiple-stepped shape 26 as shown in FIG. 10. Each set of the multi-step grooved rolls 25 is arranged at an interval of 250 mm, for example. In this configuration including the multi-step grooved rolls, the rolls can form the initial 8 m-length tubing stock to a shape having 32 steps over the entire length. In this case, the diameter of each step of the tubing stock is determined by providing the total length with equal divisions and gradually reducing the diameter for each division from the larger-diameter base end toward the smaller-diameter tip end. That is, the diameter for each divisional section is smaller than that for the preceding divisional section. The amount of the reduction of the diameter for each section such as $d_2$, $d_3$, $d_4$, etc. as shown in FIG. 10 is determined such that starting with the first largest diameter $d_1$ section which is the diameter of the original stock, the final section which is the smallest in diameter can be reduced to the desired diameter dn. After the multiple-stepped tube is thus obtained, all the motors 17, 17 for the swaging machine are started simultaneously. Then, the tube 26 is inserted into the swaging machine from the entry side where the first swaging unit $A_1$ is located, and is rapidly fed forward in the direction of an arrow 27. When the total length of the tube is inserted until its end contacts the final-stage die, each divisional section of the tube is located at the corresponding swaging units $A_1$, $A_2$, $A_3$, $A_4$, $A_5$, $A_6$, $A_7$ and $A_8$. In FIG. 1, the leftmost swaging unit is designated by $A_1$, and the rightmost swaging unit is designated by $A_8$, the intermediate swaging units being designated in the order of $A_2$, $A_3$, . . . , $A_7$. The forming processing for each divisional section is done by the dies within the corresponding swaging units. Each die has a diameter and a size specific to each divisional section so that the die can form each section to the desired diameter. As readily understood from the above description, the tapering process can be accomplished for each divisional section that has previously been provided with steps, and therefore the amount of the required reduction work can be minimized and the work can be done in a less time. Upon completion of the tapering process, the tube is withdrawn from the swaging machine, this removal being done in the reverse direction as indicated by an arrow 28, oppositely to the direction at the time of the insertion. The completed metal tube 29 is presented in FIG. 11. This metal tube 29 has slight variations in thickness for each interface area 30 between the adjacent divisional sections that existed in the original stepped stock, but those variations can advantageously improve the strength of the tube.

As each flywheel in the tandem-configured swaging machine has its own motors that cause the flywheel to rotate, every two adjoining flywheels can be rotated in identical or opposite directions. By causing the adjoining flywheels to be rotated in the opposite directions, it is possible to minimize the level of the noise and vibrations that may occur during the rotation of the flywheels. The adjoining flywheels may be rotated in the identical direction. In the construction of the swaging unit shown in FIG. 2, the thrust bearings whose number is shown as six, for example, are disposed in the radial configuration rotatably to support the adjoining flywheels. For the rotation of the adjoining flywheels in the identical direction, it should be preferable that three of the six thrust bearings are provided to support one flywheel, and the remaining three bearings and provided to support the other flywheel. The number of the thrust bearings to be used may be varied, and in any case, one half of the total number should support one flywheel whereas the other half should support the other flywheel.

The swaging machine described above may be used directly to handle an initial uniform-diameter metal tube stock instead of the multiple stepped stock that has been obtained during the preliminary process as described above. For the handling of such initial metal tubing stock, it is being gradually formed to a tapered shape while the insertion occurs, the shape providing a thickness which is gradually increasing toward the smaller diameter side, as shown in FIG. 9. During the normal swaging process, the variation or increase in the thickness is given by the following equation.

$$\left\{\left[\left(\frac{d_1}{d_2}-1\right)\times 0.8\right]+1\right\}\times t_1=t_2 \qquad (1)$$

where, $d_1$: outer diameter of initial stock.

$d_2$: outer diameter of finish (the outer diameter of the smallest-diameter end in this example)

$t_1$: thickness of initial stock.

$t_2$: thickness of finish (the thickness in the smallest-diameter end in this example)

Given $d_1=120$ mm, $d_2=70$ mm, and $t_1=3$ mm in the preceding equation (for an initial stock of a 5 m length and with a taper ratio equal to 1/100), the thickness of the finished tube in determined as follows:

$$t_2=\left\{\left[\left(\frac{120}{70}-1\right)\times 0.8\right]+1\right\}\times 3=4.71\text{ mm}$$

The variation in thickness for the multiple-stepped stock may be expressed by the following equation.

$$\left\{\left[\left(\frac{d_1}{d_2}-1\right)\times 0.4\right]+1\right\}\times t_1=t_2 \qquad (2)$$

By using the same values as above for the respective parameters in the equation (2), the result follows:

$$t_2=\left\{\left[\left(\frac{120}{70}-1\right)\times 0.4\right]+1\right\}\times 3=3.85\text{ mm}$$

It is clear from the above that the variation in thickness can be controlled to provide a proper thickness. The factor of 0.4 in the above equation (2) represents a value which is used when all the grooved roll sets at the different stages are operated at the same number of rotations. If each grooved roll set is to be operated at different numbers of rotations, that is, the grooved roll sets are operated so that the number of rotations is increasing for each succeeding grooved roll set toward the feeding direction of the stock (which causes the stock to be rolled under the tensile force), the value of the above factor can be made smaller.

The following is a description of the multiple-stage grooved roll arrangement that is used as a preliminary step to form an initial tubing stock to a multiple-stepped shape. FIGS. 8 through 11 represent the different forms of the tubing, depending, upon how the tubing stock is processed except for the form in FIG. 8 which is an initial stock having a uniform diameter. Each of those forms has a length of $l_0$, $l_1$, $l_2$, and $l_3$ as shown, those lengths having the following relationship:

$$l_0<l_1<l_2<l_3$$

When an initial tubing stock 24 of a length $l_0$ is directly processed by means of the swaging machine, it is formed to a tapered shape whose length $l_1$ is greater than that of the original stock. When the initial stock is previously formed to a multiple-stepped shape, it will have a length of $l_2$ which is greater than the length $l_1$ because it is elongated the more as the amount of increase in thickness is the less. When the multiple-stepped shape is then processed by the swaging machine, a slight amount of elongation can be expected to occur with the resulting length $l_3$ becoming greater than that of the original multiple-stepped shape. As it is clear from the above, this means that when the initial stock is previously formed to a multiple-stepped shape and it is then used for the final tapering process, it provides an economical means of saving the amount of the material to be used since it permits the use of the initial stock that is shorter than otherwise.

Figures 12, 13:
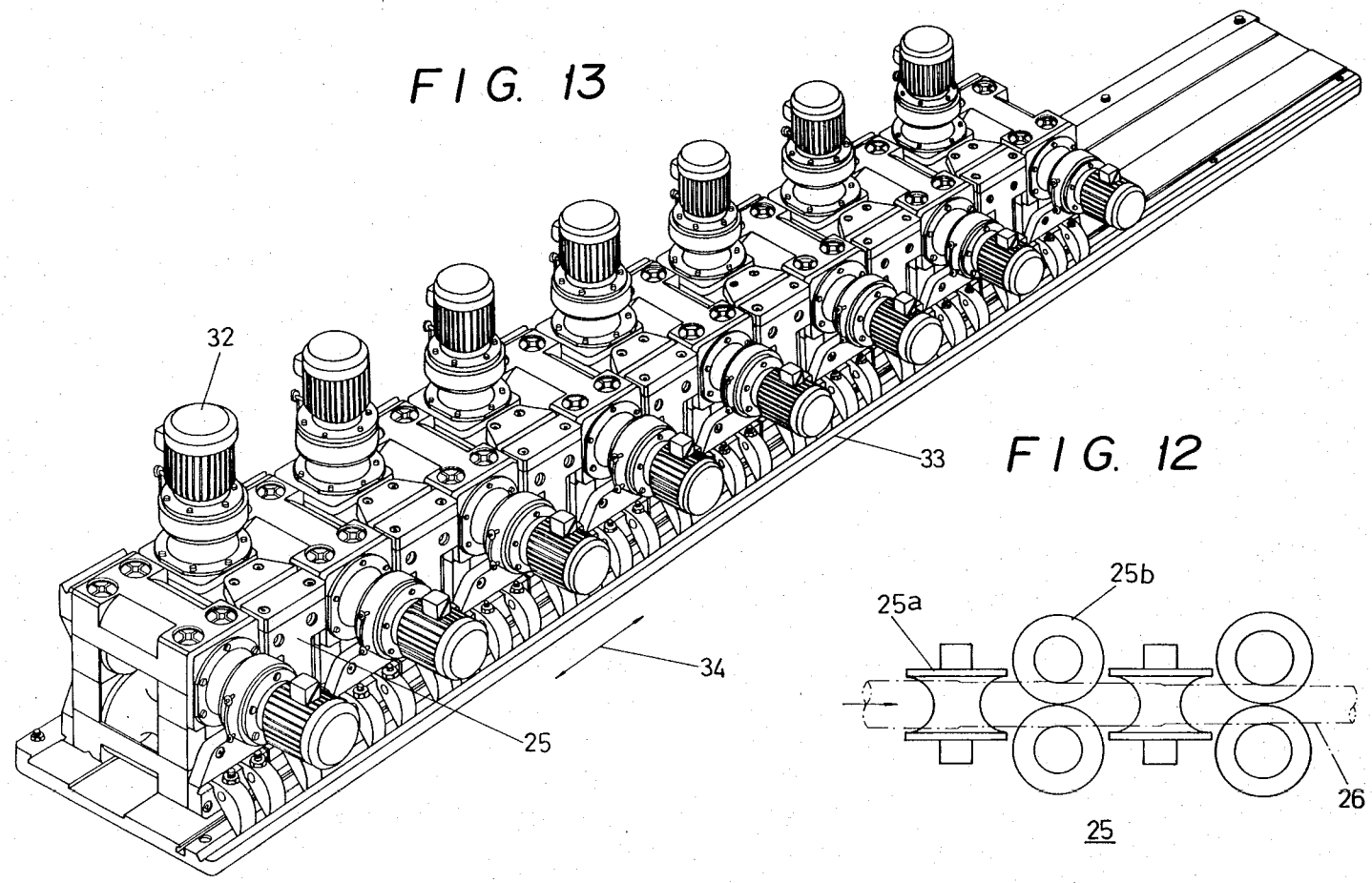
FIG. 12 is a partly enlarged front view illustrating how the grooved rolls are disposed relative to each other in the multiple-stage grooved roll arrangement.
FIG. 13 is a perspective view illustrating the mechanism of the multiple-stage grooved roll arrangement, with some similar portions omitted from the view.

The construction of the multi-stage grooved roll arrangement which is used to form the initial stock to a multiple-stepped shape is shown in FIGS. 12 and 13. Details of the construction are presented as follows.

The construction includes several sets of grooved rolls generally designated by 25, each set including two subsets 25*a* and 25*b* of grooved rolls which face opposite each other. The two subsets 25*a* and 25*b* are arranged perpendicularly to each other such that the rolls in one subset 25*a*, for example, are disposed in a horizontal plane and the rolls in the other subset 25*b*. for example, are disposed in a vertical plane. In each set, at least one subset of rolls such as shown by 25*a*, for example, is driven by means of a motor 32. Each set 25 of rolls is arranged at regular intervals of 250 mm, for example, in the longitudinal direction of the passage through which a work is to travel. Thus, the stock that has been passed through those roll sets is formed to a multiple-stepped shape having each divisional section of 250 mm long between the two adjacent steps. In other words, each step is formed at an interval of 250 mm along the length of the work.

All sets 25 of grooved rolls are arranged in an adjustably spaced relationship on a common base 33, on which each set is immovably but adjustably mounted and is physically independent of each other. The common base is long enough to permit an adjustment of the distance between the adjacent sets 25, depending upon the length of each divisional section of a stock to be worked. The adjustment of the distance can be made by displacing each set forth and back in the direction of a double arrow 34. As such, the grooved roll arrangement can provide a multiple-stepped shape having each divisional section of any variable length through a single-pass processing.

The following description is presented to explain how an example of the method according to the present invention is to be performed. The steps for carrying out the method are as follows.

Initially, an initial metal tubing stock having a uniform diameter of 120 mm, a thickness of 3 mm and a length of 15 m is passed through the above described multiple grooved roll arrangement. The tube thus obtained presents multiple steps over the length (in this example, 20 steps are formed). In this case, the reduction of the diameter for each divisional section which forms each step is assumed to occur within the value of 2%. The diameter for each section that is desired to be reduced can be obtained by the following equation:

$$d_1 \times 0.98 = d_2 \quad (3)$$

After the stock have been formed to the multi-stepped shape, the next step is to pass it through the tandem-configured swaging machine. As the initial stock used in this example is 5 m long, the first five swaging units in the tandem configuration shown in FIG. 1 are used. Those swaging units are set up so that the die size and length in each swaging unit meet the dimensional requirements of each step and divisional section of the preprocessed stock. The insertion through the machine starts with the smallest diameter end of the stock. When the total length of it is completely inserted, the machine is operated. A single operation that takes place for 10 to 15 seconds can provide a tapered shape having the thickness of 3 mm at the largest diameter end and the thickness of 3.85 mm at the smallest diameter end.

The various forms of the present invention have been described in detail. The tandem-configured swaging machine can provide an effective, easy mass manufacturing means by which any initial metal tubing stock which is 1 m or longer can be handled in a single operation. The multiple grooved roll arrangement to be used as a preliminary step in conjunction with the above tandem-configured swaging machine can provide a multiple-stepped shape, which is then processed by the swaging machine with the resulting variation in thickness being limitted to as little as possible. Therefore, using the grooved rolls in conjunction with the tandem configuration can provide both increased working efficiency and economical means of saving the amount of the material to be used. The tandem-configured swaging machine can be used alone without the use of the grooved roll arrangement as a preliminary step. In this case, the same advantages as mentioned above can be achieved.

Although the present invention has been described in connection with the various forms of the embodiment thereof, it should be understood that various changes and modifications may be made within the spirit and scope of the invention.

What is claimed is:

1. An apparatus for forming a relatively long metal tubing stock to a tapered shape by means of the swaging process, comprising a plurality of swaging units which are arranged in a serial tandem configuration, each of said swaging units including:

an outer cylindrical-shape flywheel;

an inner cylindrical-shape assembly mounted inside said outer cylindrical-shape flywheel, said assembly including hammer rolls arranged at regular intervals around said assembly and spacer members each interposed between the two adjacent hammer rolls;

a cylindrical-shape spindle mounted inside said inner cylindrical-shape assembly, said spindle having two longitudinal bucker grooves extending in parallel with the central axis of said spindle and diametrically opposed relative to each other, each of said two bucker grooves having a series of regularly spaced apertures formed in the bottom in the longitudinal direction thereof and aligned with the apertures in the other bucker grooves, a series of striking rods each inserted into each of said apertures movably in the radial direction of said spindle, and a bucker mounted between said series of striking rods in each of said bucker grooves and said inner cylindrical-shape assembly so that said bucker is pressed down by said hammer rolls in said inner assembly;

working die means mounted inside said spindle, said working die means having two split parts extending longitudinally thereof; and driving means having output connected to said outer cylindrical-shape flywheel, wherein each of said working die means in each of said swaging units is interconnected one after another to form a continuous working sequence, and each of said driving means is connected to each of said outer cylindrical-shape flywheel.

2. An apparatus as defined in claim 1, wherein said spacer members are made of mechanically strong and light-weight synthetic resin materials.

3. An apparatus as defined in claim 1, wherein each of said working die means has an abutting end which closely contacts that of an adjoining working die means when they are interconnected, and all of said working die means have a similar taper shape along the length thereof.

4. An apparatus as defined in claim 1, wherein the adjoining flywheels are capable of rotation in the identical or opposite direction.

5. An apparatus as defined in claim 1, wherein the alternately arranged hammer rolls and spacer members in said inner cylindrical-shape assembly are securely held together by means of outer and inner binding ring members.

6. An apparatus as defined in claim 1, wherein the individual swaging units in the tandem configuration are operated independently of each other, and the working passage formed by the die means in each of the swaging units in the tandem configuration is long enough to accommodate the total length of the tubing stock.

* * * * *